US005863681A

United States Patent [19]

Helmetag

[11] Patent Number: 5,863,681

[45] Date of Patent: Jan. 26, 1999

[54] COMPOSITE SHADOW MASK

[75] Inventor: Klaus-Peter Helmetag, Hagen-Holthausen, Germany

[73] Assignee: Wickeder Westgalenstahl GmbH, Germany

[21] Appl. No.: 715,908

[22] Filed: Sep. 19, 1996

[51] Int. Cl.[6] ..... G03C 5/00

[52] U.S. Cl. ..... 430/23; 430/5; 216/12

[58] Field of Search ..... 428/615; 216/12; 430/5, 23; 156/306.3

[56] References Cited

U.S. PATENT DOCUMENTS

| | | | |
|---|---|---|---|
| 3,423,261 | 1/1969 | Frantzen | 156/11 |
| 3,574,013 | 4/1971 | Frantzen | 156/8 |
| 4,420,366 | 12/1983 | Oka et al. | 156/644 |
| 4,472,236 | 9/1984 | Tanaka et al. | 156/642 |
| 4,585,518 | 4/1986 | Ohtake | 156/644 |
| 4,896,813 | 1/1990 | Saijo et al. | 228/116 |
| 5,308,723 | 5/1994 | Inoue et al. | 430/23 |
| 5,488,263 | 1/1996 | Takemura et al. | 313/402 |
| 5,686,784 | 11/1997 | Thoms et al. | 313/402 |

*Primary Examiner*—M. Nuzzolillo
*Assistant Examiner*—Steven H. Versteeg
*Attorney, Agent, or Firm*—Jacobson & Johnson

[57] ABSTRACT

A shadow mask of two different metals which are cold rolled into adhesion with the shadow mask made from a first metal having a coefficient of thermal expansion on the order of glass and a second metal having a coefficient of thermal expansion substantially greater than glass with the first metal forming a framework for holding the second metal in position even though the temperature of the first and second metals is elevated.

9 Claims, 3 Drawing Sheets

COMPOSITE SHADOW MASK

FIELD OF THE INVENTION

This invention relates generally to shadow masks for use in television tubes, and more specifically, for making a shadow mask of two different materials by cold rolling a first metal and a second metal to form an etchable, shadow mask composite material.

BACKGROUND OF THE INVENTION

The concept of shadow masks for use in television tubes is well known in the art. Typically, a shadow mask having small openings is located in a television tube and acts as guide for the electron beams. Because the shadow mask undergoes a substantial increase in temperature during operation of the television, the shadow mask material expands in accordance with the coefficient of thermal expansion of the mask material, and the increase in temperature. As the shadow mask is used as a guide for electron beams that impinge on the phosphor dots on the glass plate, it is necessary to maintain the proper relationship of the shadow mask to the glass plate even though the temperature of the televisions tube increases during operation of the television. Unfortunately, the glass where the phosphor regions are located has a lower coefficient of thermal expansion than the shadow mask, which can result in misalignment of the shadow mask and the glass. One of the prior art methods of minimizing problems produced by the differences in the thermal expansion rates of the glass and the shadow mask, is to make a shadow mask of a metal which has a coefficient of thermal expansion on the order of the glass. One such commonly used material is a nickel-iron alloy known as an INVAR™ alloy. INVAR™ alloys can be produced to have a coefficient of thermal expansion on the same order as the glass, thus minimizing the effects of misalignment. One of the drawbacks in the use of Invar alloys is that the Invar alloys are generally more expensive than the conventional steel alloys and make the shadow mask more costly.

The present invention provides a composite shadow mask material formed of bands of a first metal and a sheet of a second metal. The metals are cold rolled together under sufficient pressure so as to form a unitary shadow mask material. The bands of the first metal are made from an alloy having a coefficient of thermal expansion on the order of the glass inside the television tube, and the second metal is made from less costly alloys which have a higher coefficient of thermal expansion. The composite material utilizes the bands of the first metal to form a support to restrain the thermal expansion of the second metal so that the alignment of the shadow mask and the glass plate can be maintained during operation of the television tube.

BRIEF DESCRIPTION OF THE PRIOR ART

U.S. Pat. No. 3,574,013 shows a shadow mask wherein the base material is etched to form opening, and then a second layer of metal is electroformed on top of the base material.

U.S. Pat. No. 4,585,518 shows a method of manufacture of a shadow mask made of an Invar alloy, with the Invar alloy cold rolled and the viscosity of the etchant is maintained within certain limits to ensure that the Invar is etched to proper size.

U.S. Pat. No. 4,472,236 shows a method for etching nickel-iron alloys without decreasing the etching capability of the etching solution.

U.S. Pat. No. 4,420,366 shows a method of etching a nickel-iron allow by spraying etchant, wherein the etchant parameters are maintained within certain limits.

SUMMARY OF THE INVENTION

A method of making a shadow mask of two different materials wherein one forms bands of a first metal having a thickness $t_2$ with the bands of the first metal having a first coefficient of thermal expansion $C_b$ and a sheet of a second metal having a thickness $t_1$ with the thickness $t_1$ being on the order of at least 5 times $t_2$ with the sheet of second metal having a coefficient of thermal expansion $C_s$ with the coefficient of thermal expansion $C_s$ being greater than the coefficient of thermal expansion $C_b$, and then placing the bands of the first metal on the sheet of the second metal, and cold rolling the bands of first metal and the sheet of second metal under sufficient pressure to produce cold roll adhesion between the bands of the first metal and the sheet of the second metal. The result is a shadow mask material having a unitary layer of the first metal and the second metal so that when the shadow mask material is etched and placed in a television tube, the thermal expansion encountered in a television tube is insufficient to cause the bands of the first metal to separate from the sheet of the second metal, while allowing the bands of the first metal to restrain the thermal expansion of the sheet of the second metal.

DESCRIPTION OF THE PREFERRED EMBODIMENT

Figure 1:
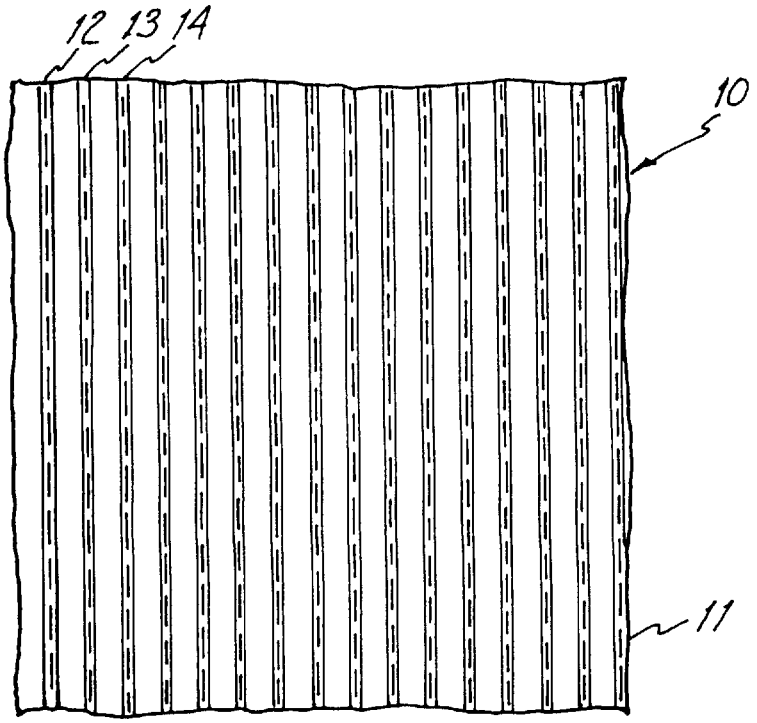
FIG. 1 shows a front view of a shadow mask with bands of material cold rolled onto the base material.

Referring to FIG. 1, reference numeral 10 identifies a shadow mask made according to the method of the present invention. Mask 10 comprises a mask material formed of a sheet of metal 11 with a plurality of parallel spaced strips or bands of a second metal which are identified by reference numerals 12, 13, and 14. While only three bands are identified, the bands of metal would extend across the face of the shadow mask which is sometimes referred to as an aperture mask.

Figure 2:
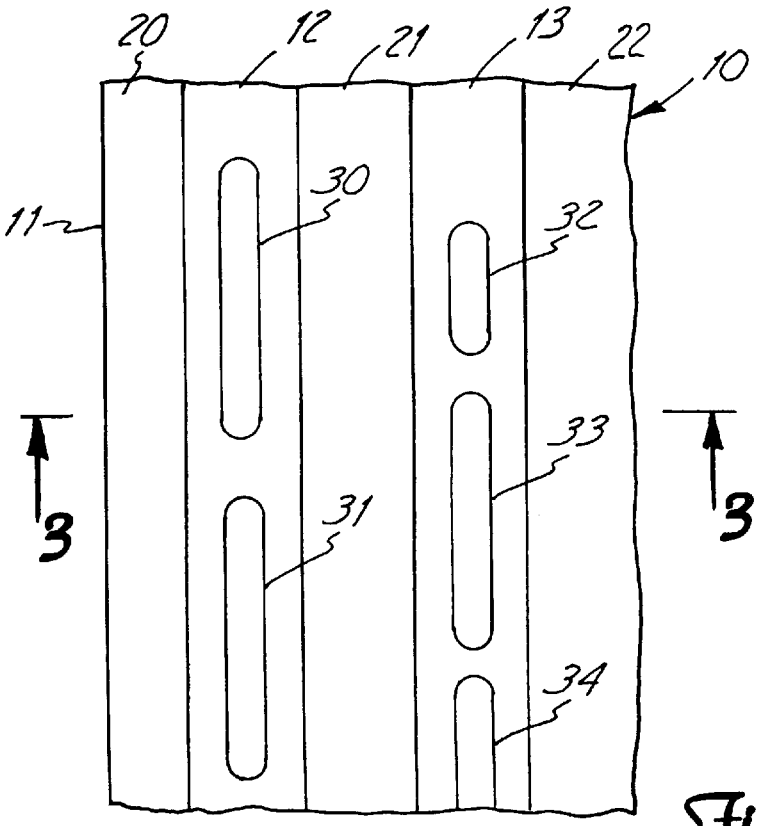
FIG. 2 shows an enlarged view of a portion of the shadow mask of FIG. 1.

FIG. 2 shows an enlarged portion of mask 10, with mask material 11 having surface areas 20, 21, and 22 located between bands of material 12 and 13. Located in band 12 is a first elongated opening 30 and a second elongated opening 31. Similarly, located in band 13 are elongated openings 32, 33 and 34. While the openings are shown as being elongated, it should be understood that various shape openings can be formed in the bands of the first metal.

Figure 3:
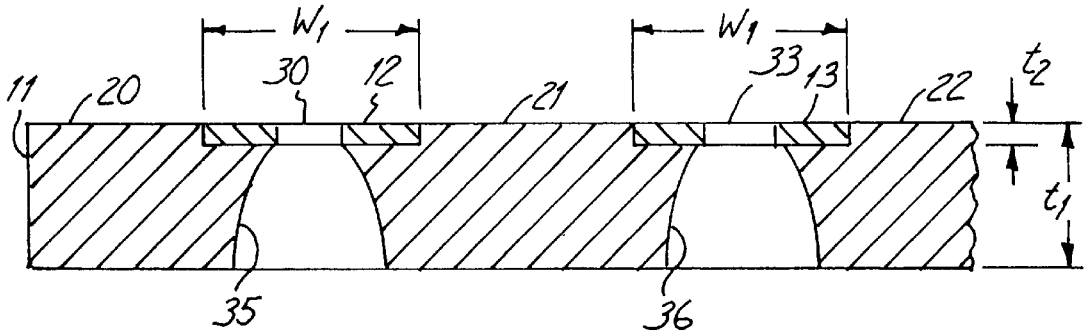
FIG. 3 shows a sectional view taken along the lines 3—3 of FIG. 2.

FIG. 3 shows a cross sectional view taken along lines 3—3 of FIG. 2, and shows that bands 11 and 12 have width $w_1$ and thickness $t_2$. The thickness of the base metal 11 is designated by $t_1$ with $t_1$ being on the order of at least 5 times $t_2$ The purpose of having $t_2$ sufficiently small is to take advantage of the cost differences between INVAR™ alloys and the less expensive base metal 11. That is, the INVAR™ alloys are substantially more costly than the base metals. From an economical standpoint, the less INVAR™ alloy used, the less costly the shadow mask is to produce. On the other hand, the base steel does not have the proper thermal expansion characteristics. That is, the coefficient of thermal expansion of the base steel is on the order of ten times the coefficient of expansion of the INVAR™ alloys.

In the present process, one forms bands of a first metal, such as an INVAR™ alloy, having a thickness $t_2$ with the bands of the first metal having a first coefficient of thermal expansion $C_b$. Then one forms a sheet of a second metal, such as a mild steel, having a thickness $t_1$ with the thickness $t_1$ being on the order of at least 5 times $t_2$ with the sheet of second metal having a coefficient of thermal expansion $C_s$ which is typically on the order of at least 5–10 times greater than the coefficient of thermal expansion $C_b$ of the first metal. After forming the two metals, one places the bands of the first metal on the sheet of the second metal and cold rolls the bands of first metal and the sheet of second metal into a unitary, but composite, material. To do so, one uses pressure to produce sufficient adhesion between the bands of the first metal and the sheet of the second metal to form a shadow mask material having a unitary layer of the first metal and the second metal. The pressure used during the cold rolling process is sufficiently high so that when the shadow mask material is etched and placed in a television tube, the thermal expansion encountered in a television tube is insufficient to cause the bands of the first metal to separate from the sheet of the second metal while allowing the bands of the first metal to restrain the thermal expansion of the sheet of the second metal.

Figure 4:
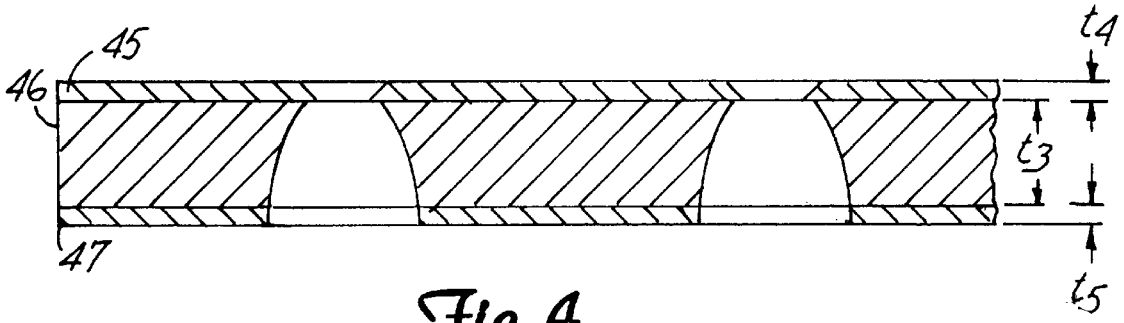
FIG. 4 shows an alternate embodiment of the invention, wherein the bands of material are cold rolled to opposite sides of a base material.

FIG. 4 shows an alternate embodiment of the invention wherein the base metal 46 with a higher coefficient of thermal expansion is sandwiched between a top layer of INVAR™ alloy 45 and a bottom layer of INVAR™ alloy 47. The thickness of the base metal is designated as $t_3$ with the thickness of the INVAR™ alloy layers designated as $t_4$ and $t_5$.

Figure 5:
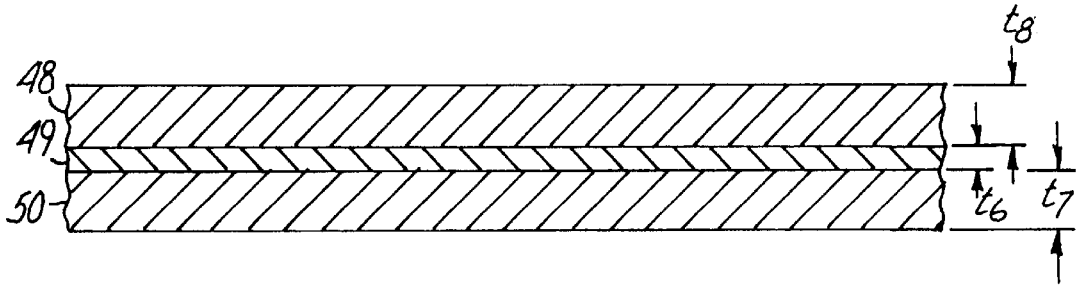
FIG. 5 shows further alternate embodiment of the invention wherein a band of the low coefficient of expansion material is cold rolled between two sheets of metal having a higher coefficient of expansion.

FIG. 5 shows a still further embodiment of the invention, when a top layer of cold rolled steel 48 and a bottom layer of cold rolled steel 50 have been further cold rolled around a layer 49 of nickel-iron steel such as an INVAR™ alloy. The thickness layer of cold rolled steel is designated as $t_8$ and $t_7$ with the thickness of the layer of the INVAR™ alloy designated as $t_6$.

Figure 6:
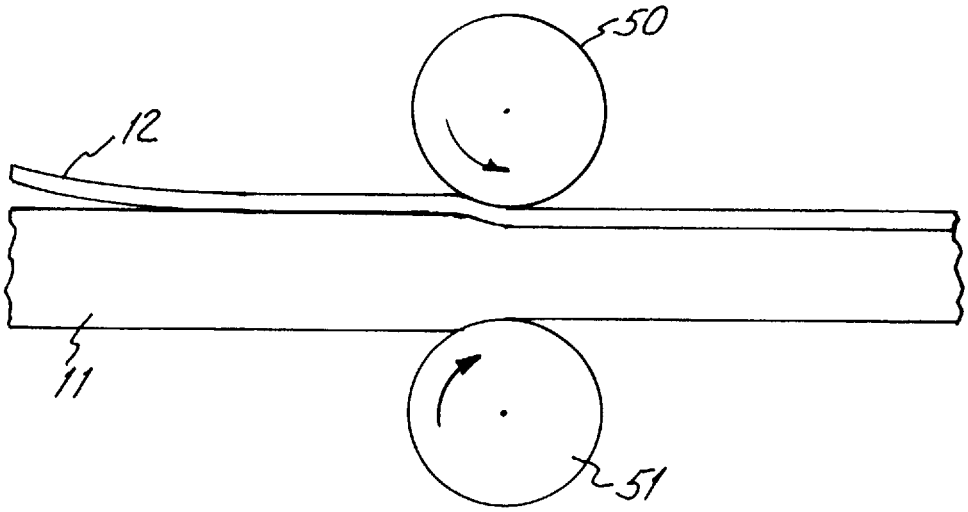
FIG. 6 shows two metals being cold rolled under sufficient pressure to cause the two metals to adhere to each other and form a unitary structure.

FIG. 6 shows a first layer of metal 12 and a second layer of metal 11 passing between pressure rollers 50 and 51 to cold roll the two materials into a unitary structure comprised of two distinct metals.

Figure 7:
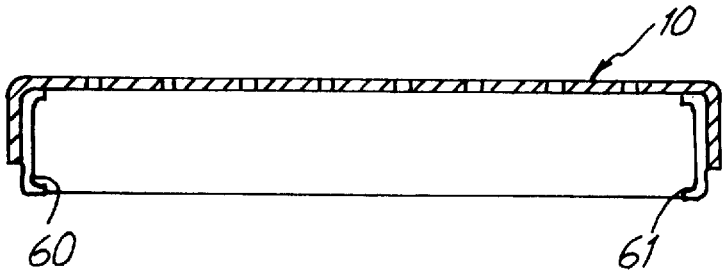
FIG. 7 shows a cross section view of a shadow mask stretched across supports.

FIG. 7 shows a shadow mask 10 stretched across supports 60 and 61 to enable the INVAR™ alloy to restrain the expansion of the metal with the higher thermal expansion.

The invention comprises a method of making a shadow mask 10 of two different materials comprising the steps of: forming bands of a first metal 11 such as INVAR™ comprising 36% nickel and the balance iron having a thickness $t_2$ with the bands of the first metal 11 having a first coefficient of thermal expansion $C_b$ with the bands of the first metal are spaced from each other in a substantial parallel relationship as shown in FIG. 2 and forming a sheet of a second metal 11 of cold rolled steel having a thickness $t_1$ with the thickness $t_1$ in the range of 0.3 to 0.5 microns and being on the order of at least 5 times $t_2$, with the sheet of second metal having a coefficient of thermal expansion $C_s$, with the coefficient of thermal expansion $C_s$ being at least 5–10 times greater than the coefficient of thermal expansion $C_b$.

FIG. 1 shows placing the bands of the first metal 12, 13 and 14 on the sheet of the second metal 11 and FIG. 6 shows the cold rolling the bands of first metal 12 and the sheet of second metal 11 under sufficient pressure to produce sufficient adhesion between the bands of the first metal and the sheet of the second metal to form a shadow mask material having a unitary layer of the first metal and the second metal so that when the shadow mask material is etched and placed in a television tube, the thermal expansion encountered in a television tube is insufficient to cause the bands of the first metal to separate from the sheet of the second metal, while allowing the bands of the first metal to restrain the thermal expansion of the sheet of the second metal.

The bands of the first metal and the second metal are etched to form a set of apertures for projection of light beams therethrough and to form a portion of a cavity in the shadow mask material and the sheet of the second metal is etched to form a further cavity, with the first cavity and the further cavity defining an opening through the shadow mask material.

The invention also comprises a shadow mask of unitary construction comprising: a first layer of metal being a band of INVAR™ alloy 12 comprising 36% nickel and the balance iron with the first layer of metal having a first coefficient of thermal expansion, with the first coefficient of thermal expansion being on the order of the coefficient of thermal expansion of glass and a second layer of metal, the second layer of metal having a coefficient of thermal expansion which is substantially greater than the coefficient of thermal expansion of glass. The first layer of metal and the second layer of metal are secured to each other solely though adhesion produced by cold rolling the two metals together so that the resulting shadow mask material has sufficient structural support, so that the first layer of metal can prevent the second layer of metal from expanding sufficiently to cause the shadow mask from becoming out of alignment with a phosphor pattern in a television tube.

I claim:

1. A method of making a shadow mask of two different materials comprising the steps of:

forming bands of a first metal having a thickness $t_2$ with the bands of the first metal having a first coefficient of thermal expansion $C_b$;

forming a sheet of a second metal having a thickness $t_1$ with said thickness $t_1$ being on the order of at least 5 times $t_2$, with said sheet of second metal having a coefficient of thermal expansion $C_s$, with said coefficient of thermal expansion $C_s$ being at least 5–10 times greater than the coefficient of thermal expansion $C_b$;

placing the bands of the first metal on the sheet of the second metal and cold rolling the bands of first metal and the sheet of second metal under pressure to produce adhesion between the bands of the first metal and the sheet of the second metal to form a shadow mask material having a unitary layer of the first metal and the second metal so that when the shadow mask material is etched and placed in a television tube, the thermal expansion encountered in a television tube is insufficient to cause the bands of the first metal to separate from the sheet of the second metal, while allowing the bands of the first metal to restrain the thermal expansion of the sheet of the second metal; and forming a plurality of etched openings through both said first metal and said second metal.

2. The method of claim 1 wherein the bands of the first metal are formed of an alloy comprising 36% nickel and the balance iron.

3. The method of claim 2 wherein the sheet of metal is formed of cold rolled steel.

4. The method of claim 3 wherein the thickness $t_1$ is in the range of 0.3 to 0.5 microns.

5. The method of claim 4 wherein the bands of the first metal are spaced from each other in a parallel relationship.

6. The method of claim 5 wherein the bands of the first metal are etched to form a portion of a cavity in the shadow mask material and the sheet of the second metal is etched to form a further cavity, with the first cavity and the further cavity defining an opening through the shadow mask material.

7. A shadow mask of unitary construction comprising:

a first layer of metal, said first layer of metal having a first coefficient of thermal expansion, with the first coefficient of thermal expansion being on the order of the coefficient of thermal expansion of glass;

a second layer of metal, said second layer of metal having a coefficient of thermal expansion which is greater than the coefficient of thermal expansion of glass, said first layer of metal and said second layer of metal secured to each other solely though adhesion produced by cold rolling the two metals together so that the resulting shadow mask material has structural support, so that the first layer of metal can prevent the second layer of metal from expanding to cause the shadow mask from becoming out of alignment with a phosphor pattern in a television tube and;

a plurality of openings extending through both said first layer of metal and said second layer or metal for passage of an electron beam therethrough.

8. The shadow mask of claim 7, wherein the first metal is an alloy having 36% nickel and the balance iron.

9. The shadow mask of claim 8 wherein the first metal comprises bands of alloy having 36% nickel and the balance iron.

* * * * *